US007380801B2

(12) United States Patent
Rudolph

(10) Patent No.: US 7,380,801 B2
(45) Date of Patent: Jun. 3, 2008

(54) ICE SKATE BLADE RUNNER HOLDER AND BLADE RUNNER AND METHOD OF MANUFACTURE

(75) Inventor: Robert K. Rudolph, Gurnee, IL (US)

(73) Assignee: Paramount SK8S, Inc., Gurnee, IL (US)

( * ) Notice: Subject to any disclaimer, the term of this patent is extended or adjusted under 35 U.S.C. 154(b) by 0 days.

(21) Appl. No.: 11/186,393

(22) Filed: Jul. 21, 2005

(65) Prior Publication Data

US 2006/0043686 A1 Mar. 2, 2006

Related U.S. Application Data

(60) Provisional application No. 60/589,646, filed on Jul. 21, 2004, provisional application No. 60/609,851, filed on Sep. 14, 2004.

(51) Int. Cl.
*A63C 1/30* (2006.01)

(52) U.S. Cl. ..... 280/11.18; 280/11.12

(58) Field of Classification Search ..... 280/11.12, 280/11.17, 11.18
See application file for complete search history.

(56) References Cited

U.S. PATENT DOCUMENTS

| | | | | | |
|---|---|---|---|---|---|
| 524,129 | A | * | 8/1894 | Bryant | 280/11.18 |
| 803,269 | A | * | 10/1905 | Bryant | 280/11.18 |
| 1,319,094 | A | | 10/1919 | Kerrigan | |
| 1,608,963 | A | | 11/1926 | Smilden | |
| 2,096,781 | A | | 10/1937 | Blochinger | |
| 2,230,553 | A | * | 2/1941 | Weisman | 280/11.12 |
| 3,026,119 | A | | 3/1962 | Charles | |
| 3,027,172 | A | | 3/1962 | Vaillancourt | |
| 3,036,840 | A | * | 5/1962 | Norgiel | 280/11.18 |
| 3,610,869 | A | * | 10/1971 | Ito et al. | 219/77 |
| 3,947,050 | A | | 3/1976 | Isely | |
| 3,967,832 | A | * | 7/1976 | Chambers | 280/11.12 |
| 4,071,938 | A | | 2/1978 | Chambers | |
| 4,085,944 | A | | 4/1978 | Chambers | |

(Continued)

FOREIGN PATENT DOCUMENTS

| | | |
|---|---|---|
| DE | 521831 | 3/1931 |

(Continued)

*Primary Examiner*—Christopher P. Ellis
*Assistant Examiner*—Brian Swenson
(74) *Attorney, Agent, or Firm*—The Law Office of Randall T. Erickson, PC

(57) ABSTRACT

A method of manufacturing a blade of an ice skate includes the steps of providing a T-shaped stock piece of material having a plate and a leg extending from a center of the plate; machining the plate to form at least one mounting platform for connecting the blade to a skate shoe; machining the leg to form a skate body section that extends from the platform and includes a blade runner holder portion having a diamond cross-sectional shape with a downwardly directed slot. A separate blade runner is fixed to the blade runner holder portion within the slot and positioned for contacting the ice when in use. The blade runner is formed by providing a blade runner-shaped workpiece having a substantially constant thickness; using a vein cutting tool, and machining both lateral sides of an upper edge region of the blade runner-shaped workpiece simultaneously to form a thinner base region. The base region is sized to fit and be secured within the slot.

18 Claims, 20 Drawing Sheets

U.S. PATENT DOCUMENTS

| | | | | | |
|---|---|---|---|---|---|
| 4,088,335 | A | | 5/1978 | Norton et al. | |
| 4,093,249 | A | * | 6/1978 | Chambers | 280/11.12 |
| 4,131,288 | A | * | 12/1978 | Wilson | 280/11.17 |
| 4,196,915 | A | | 4/1980 | Cerny | |
| 4,218,069 | A | | 8/1980 | Baikie | |
| 4,251,086 | A | | 2/1981 | Woolley | |
| 5,046,746 | A | | 9/1991 | Gierveld | |
| 5,248,156 | A | * | 9/1993 | Cann et al. | 280/11.18 |
| 5,255,929 | A | * | 10/1993 | Lemelson | 280/11.18 |
| 5,332,242 | A | | 7/1994 | Cann et al. | |
| 5,388,846 | A | | 2/1995 | Gierveld | |
| 5,769,434 | A | | 6/1998 | Wurthner | |
| RE35,993 | E | | 12/1998 | Gierveld | |
| 5,934,693 | A | | 8/1999 | Nicoletti | |
| 5,961,129 | A | | 10/1999 | Post et al. | |
| 6,047,972 | A | | 4/2000 | Rudolph | |
| 6,086,084 | A | * | 7/2000 | Wemmenhove | 280/602 |
| 6,105,975 | A | | 8/2000 | Shum | |
| 6,131,923 | A | | 10/2000 | Miotto | |
| 6,142,490 | A | | 11/2000 | Monroy et al. | |
| 6,318,738 | B1 | | 11/2001 | Abkowitz et al. | |
| 6,341,785 | B1 | | 1/2002 | Benoit | |
| 6,409,183 | B1 | | 6/2002 | Wemmenhove | |
| 6,467,778 | B1 | | 10/2002 | Goldsmith et al. | |
| 6,485,033 | B2 | | 11/2002 | Nicoletti et al. | |
| 6,761,363 | B2 | * | 7/2004 | Fask et al. | 280/11.18 |
| 6,830,251 | B2 | * | 12/2004 | Titzmann | 280/11.18 |
| 6,932,361 | B2 | * | 8/2005 | Steinhauser, Jr. | 280/11.18 |
| 2003/0234499 | A1 | * | 12/2003 | Rudolph | 280/11.17 |

FOREIGN PATENT DOCUMENTS

| | | | |
|---|---|---|---|
| DE | 522751 | | 4/1931 |
| EP | 0060722 | A1 | 9/1982 |
| EP | 0311196 | A1 | 4/1989 |
| EP | 0867207 | A2 | 9/1998 |
| GB | 2238252 | A | 5/1991 |
| NL | 6802568 | | 8/1969 |

* cited by examiner

ICE SKATE BLADE RUNNER HOLDER AND BLADE RUNNER AND METHOD OF MANUFACTURE

This application claims the benefit of U.S. provisional application Ser. No. 60/589,646, filed Jul. 21, 2004, and U.S. provisional application Ser. No. 60/609,851, filed Sep. 14, 2004.

TECHNICAL FIELD OF THE INVENTION

The invention relates to ice skates and the manufacture thereof. The invention particularly relates to figure skates and the manufacture thereof.

BACKGROUND OF THE INVENTION

The figure skate blade has had no major changes in over 80 years.

The current blades are made from thin plates or sheets which are 2 dimensional. The thin flat plate causes the blade to flex and bend across the entire length of the blade. The blades flex so easily they can be flexed ½ an inch or more in your hands. This flexing reduces performance.

To cover the potential market, figure skates must be in all the various sizes and types. Figure skates are conventionally provided in ¼ size increments instead of ½ size increments provided for shoes. Producing skate blades from size 7 to 12 will require the production of 20 different sizes of blades. Providing blades for a left and right skate adds up to 40 different blades that have to be produced in order to cover the market.

There are also dance blades which are made much shorter and with different teeth and as many as 70 different blades. For manufacturing standpoint this is very difficult and not cost efficient.

The lowest cost production methods for skate blades are stamping, forging, or casting. All of these procedures require expensive dies, costing as much as $200,000 each. Multiply this by the 70 different blades and this is a large investment.

Some ice skates incorporate a blade runner holder fastened to the shoe portion of the ice skate, and a blade runner mounted to the blade holder, and intended to be in contact with the ice. For some ice skates blade runners, the runner includes a thickened blade portion that is formed with a thinner base portion. The thinner base portion is typically cut from a piece of stock that forms the thickened blade portion. Once cut, the base portion is adhesively secured into a groove of the blade runner holder.

The base portion can be cut with one tool but it is very time consuming and difficult to align one side exactly with the other. The skate blade runner is typically made from stainless steel which is a very difficult metal to machine. A great amount of pressure has to be applied to cut and remove material while the piece of stock is held in a fixture. When cutting with a regular tool, such as a milling bit, machining is done on one side at a time. Problems are presented, associated with such a small thin part as the base portion. The thin base portion can bend and can break under excess pressure. Many passes with the tool are needed, back and forth, to remove the desired amount of material from the piece of stock. The piece of stock also has to be taken out of the fixture and reinstalled to machine on the opposite side. This is a costly procedure.

SUMMARY OF THE INVENTION

The present invention provides a skate blade holder for mounting a blade runner for an ice skate. The skate blade holder is economically manufactured using the method of the invention. The blade holder which results from the inventive manufacturing method has style and performance advantages over conventionally manufactured skate blades.

The method of manufacturing a blade of an ice skate, comprising the steps of:

providing a T-shaped stock piece of material having a plate and a leg extending from a center of the plate;

machining the plate to form at least one mounting platform for connecting the blade to a skate shoe;

machining the leg to form a skate body section that extends from the platform to a position adjacent the ice when in use.

Preferably, the method can include the further step of machining an end of the leg to form a slot, and providing a separate blade runner for contacting the ice when in use, and fixing the blade runner into the slot.

Preferably, the method step of machining the skate body section is further defined in that the skate body section is machined to have a blade runner holder portion having a diamond cross-sectional shape that carries the slot and a plurality of pillar portions extending from the blade runner holder portion to the platform.

Preferably, the method step of machining the skate body section is further defined in that three pillar portions are formed, and the step of machining the plate is further defined in that the at least one platform comprises a sole plate and a heel plate formed with a gap therebetween, wherein two pillar portions are connected to the sole plate and one pillar portion is connected to the heel plate.

Preferably, the method step of machining the skate body section is further defined in that the pillar portions are tapered in both of forward and rearward direction.

Preferably, the method step of providing a separate blade runner is further defined by the steps of providing a blade runner-shaped workpiece having a substantially constant thickness; and machining both lateral sides of an upper edge region of the blade runner-shaped workpiece simultaneously to form a thinner base region, the base region sized to fit within the slot.

Preferably, the method step of machining both lateral sides of the blade runner-shaped workpiece is undertaken using a vein cutting tool.

Preferably, the method can include providing a flat sheet of stock material and laser cutting a plurality of the work pieces from the sheet.

Preferably, the method can include the further step of, after the step of machining, heat treating the workpiece while holding the workpiece in a correct curvature.

According to the method of manufacture of the invention, different sizes of blades can easily be produced with no large investment of dies or castings. A specially shaped extrusion is used for the starting stock piece. The extrusion can be cut to the desired length for the particular sized skate blade. The extrusion of the invention includes a pre-selected cross sectional shape which optimally matches the finished blade holder and which minimizes scrap material. The shape of the blade holder formed from the stock piece is easily formed with the process of Computer Numerical Control ("CNC") machining.

The CNC machine rotates a cutting tool at high speed and moves in 3 directions. The Y movements being forward and backward, X being left and right and Z up and down or in all 3 dimensions. The key to saving money and time on production is by having a special cutting tool made with an angle tip to match the angle of the taper on the skate blade holder. Having this special tool greatly improves the speed of production. One angle tool can make one pass along the top and one along the bottom in one pass producing the entire surface of the tapered-shape skate holder in only one or 2 minutes of machining time.

The blade holder is then flipped over and the other side is machined the same way creating a mirror image of the first side.

The blade holder of the invention will dramatically improve the skater's performance with a significant reduction in weight, while increasing strength and stiffness. The weight reduction is due to using a lighter more modern metal, aluminum, which is about one third the weight of the steel currently used. The weight reduction per pair is over 1 pound. The advantage of the weight reduction is that it will reduce the weight the skater has to lift high into the air and increase the height and distance of the jump. Another advantage is with skating fatigue while skating. Less weight requires less energy reducing fatigue and improving the skater's ability to perform.

Having a stiffer blade increases the power transfer or energy from the skater to the ice. As the skater pushes on the blade the flexing reduces the power like a spring reacts and absorbs energy.

The skate blade holder of the invention increases the strength and modulus or stiffness by changing the material from a flat piece of metal to a diamond shape with the middle being thicker than a normal blade. The blade holders are three-dimensional in shape which greatly adds stiffness and strength to the blade.

Aluminum has about ⅓ the stiffness or modulus of steel and in order to make it stiffer the thickness of the skate blade holder has to be thicker to compensate for the flex in the blade holder. Instead of increasing the thickness of the entire surface, only the center of the blade holder is made thicker creating a diamond shape with the upper and lower ends being relatively thin. This reduces weight while greatly stiffening the structure.

This shape also gives effective support for the blade runner which is fit inside the aluminum blade holder, and prevents failure of the aluminum blade holder from splitting apart.

The present invention also provides a unique manufacturing process used to make a blade runner, which creates a high quality product at a lower cost.

According to the inventive process a vein cutter is utilized to cut the base portion from a piece of stock. The inventive method speeds the process of producing by removing the desired material from the piece of stock in one pass, machining two surfaces at one time.

A vein cutter is actually two tools combined. A spacer is put between two rotary cutting tools, wherein the thickness of the spacer determines the thickness of the vein or the base portion to be cut. The vein cutter cuts two separate surfaces at one time leaving the center section uncut.

Each surface of the base portion cut is an exact duplicate of the other which provides a better, even fit inside the blade holder. When using a vein cutter, maximum pressure can be applied because there is no unbalanced pressure applied to the thin base portion. The pressure is applied is to the material to be removed and not the base portion itself. The base portion is also cut in one pass with both sides being cut at the same time. Time is saved by eliminating the process of taking the runner out of the fixture, flipping it over and reinstalling into a second fixture.

Once completed, the blade runner can be installed into a blade holder, using adhesive or other means.

Numerous other advantages and features of the present invention will be become readily apparent from the following detailed description of the invention and the embodiments thereof, and from the accompanying drawings.

DETAILED DESCRIPTION OF THE PREFERRED EMBODIMENTS

Figure 1:
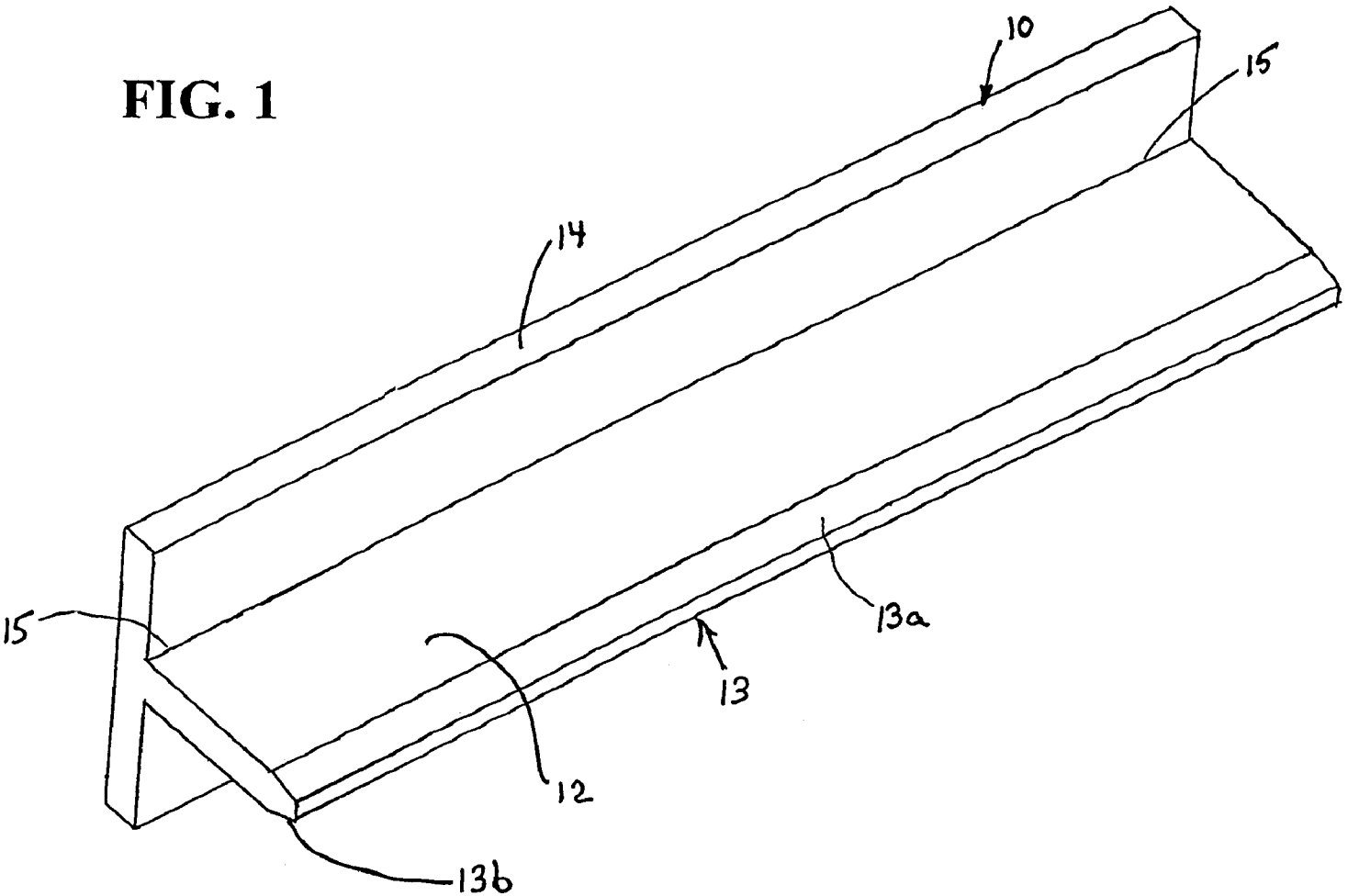
FIG. 1 is a perspective view showing a T-shaped extrusion portion.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The present invention relates to ice skates and a method of manufacture thereof. Particularly, the invention relates to the blade portion of the ice skates. Heretofore known ice skate blades are described in U.S. Pat. Nos. 3,036,840 and 2,096,781, herein incorporated by reference.

For purposes of the following description, "blade" typically refers to the structure between the ice skate shoe and the ice. According to the preferred embodiment described herein, the blade includes a blade runner holder and a blade runner mounted to the holder. The blade runner is that portion that makes sliding contact with the ice during skating.

FIG. 1 shows a portion of a T-shaped extrusion 10 formed to match the largest size figure skate blade and used to form a blade runner holder. The extrusion material is made in long lengths and cut in smaller lengths to match the size of a blade runner to be assembled thereto. The extrusion is shown on its side for better viewing. The extrusion can be composed of 6061 aluminum material.

The one piece T extrusion has two different sections. A flat rectangular leg 12 is in a horizontal plane in the drawing. A vertical plate 14 is centered and attached to the one end of the leg 12. The leg 12 is joined at 15 during the extrusion process to the center of the plate 14 creating a T shape. The leg includes a tapered edge region 13 having opposite angled surfaces 13*a*, 13*b*.

Figure 2:
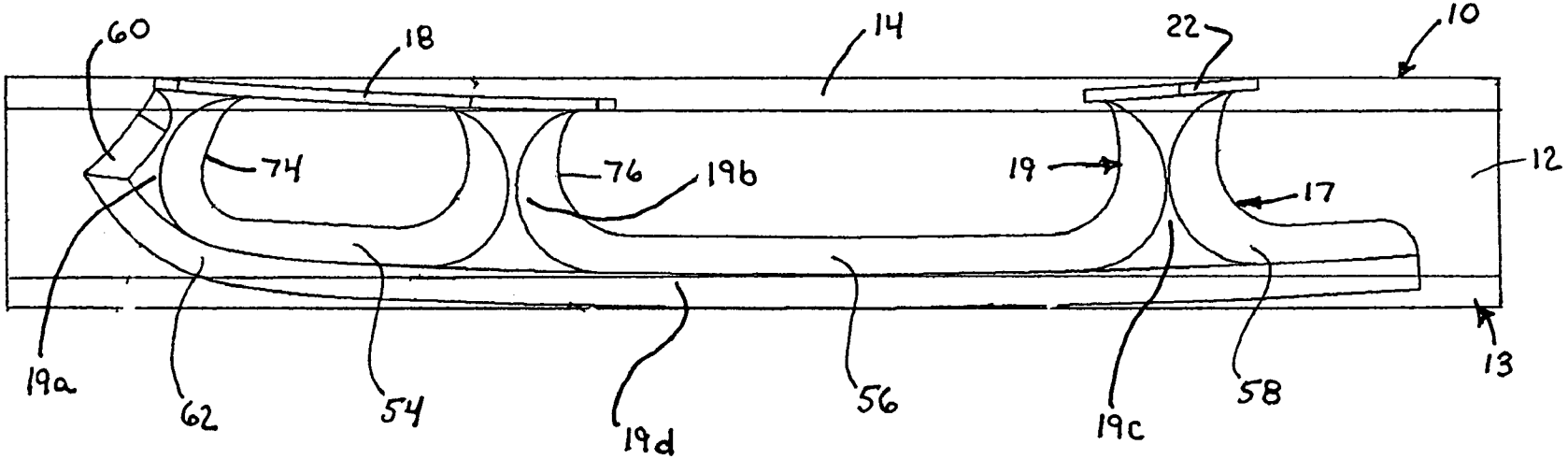
FIG. 2 is a side view of the T-shaped extrusion portion showing the skate blade holder of the invention superimposed thereon.

FIG. 2 is a side view of the T-shaped extrusion showing how the entire skate blade runner holder 17 fits inside the extrusion portion 10. A curved sole plate 18 attaches to the sole of the skate boot (not shown) and a heel plate 22 attaches to the heel of the skate boot which all fit inside the plate 14. A vertical section 19 of the blade holder 17 fits within the leg 12. The vertical section includes front pillar portions 19*a*, 19*b*, rear pillar portion 19*c* and blade runner holder portion 19*d*. The pillar portions 19*a*, 19*b* connect the sole plate 18 to the blade runner holder portion 19*d*. The pillar portion 19*c* connects the heel plate 22 to the blade runner holder portion 19*d*.

Figure 3:
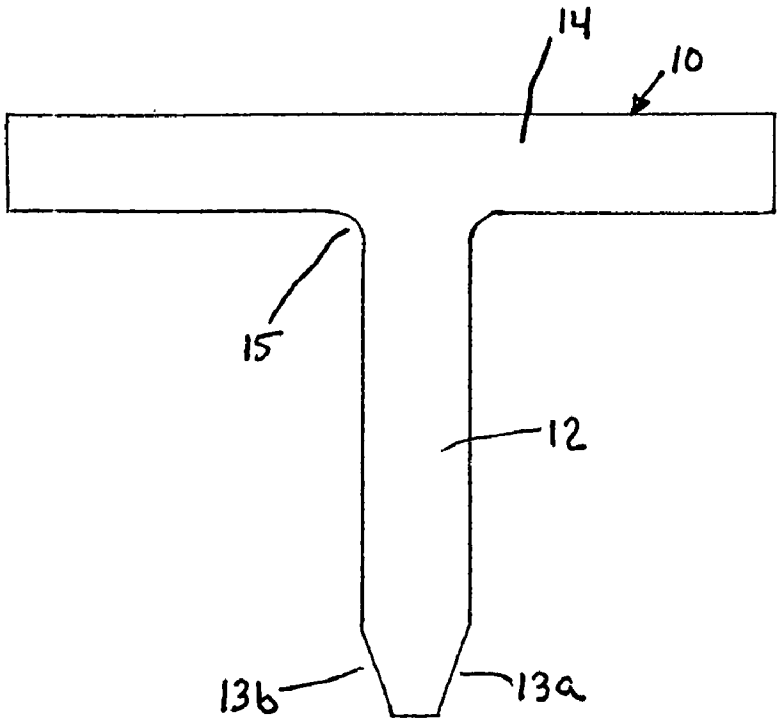
FIG. 3 is a cross-section of the extrusion portion shown in FIG. 1.

FIG. 3 shows a cross section of the T extrusion where the plate 14 is horizontal and the leg 12 is vertical. A curved section is used at 15 to increase strength where the plate 14 and the leg 12 join together.

Figure 4:
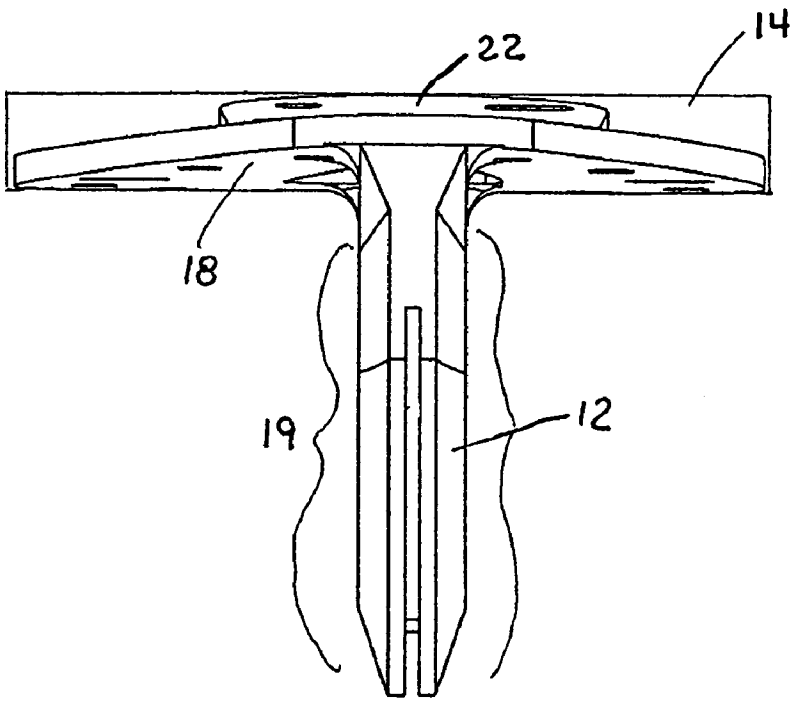
FIG. 4 is a cross-section showing the skate blade holder superimposed on the cross-section of FIG. 3.

FIG. 4 is a cross section of the extrusion portion 10 and shows a forward view and how the heel 22 and sole plate 18 fit inside the plate 14. FIG. 4 also illustrates how the vertical section 19 of the blade holder body 17 fits inside the vertical leg 12 of the extrusion portion 10. The lowest portion of the section 19 substantially matches the tapered edge 13 of the extrusion portion 10.

FIGS. 2 and 4 both show how the skate tightly fits inside the extrusion and how the extrusion saves material and machining time, especially when comparing the extrusion to a solid block.

Figure 5:
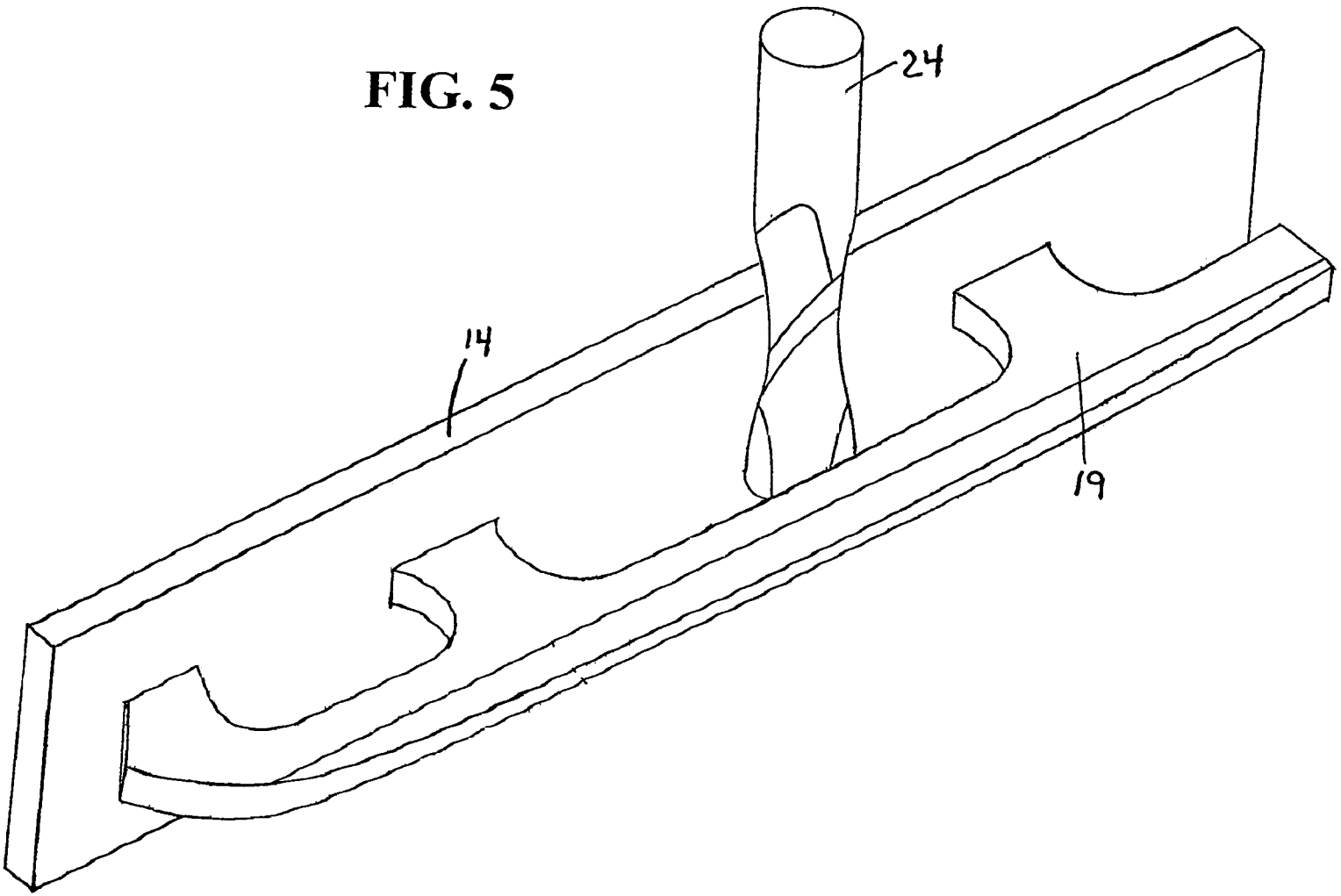
FIG. 5 is a perspective view of the extrusion portion of FIG. 1, showing a first step of a machining process illustrating how material is removed.

FIG. 5 illustrates the step of the machining process where material is removed from leg 12 of with an endmill 24 forming the rough profile of the section 19.

Figure 6:
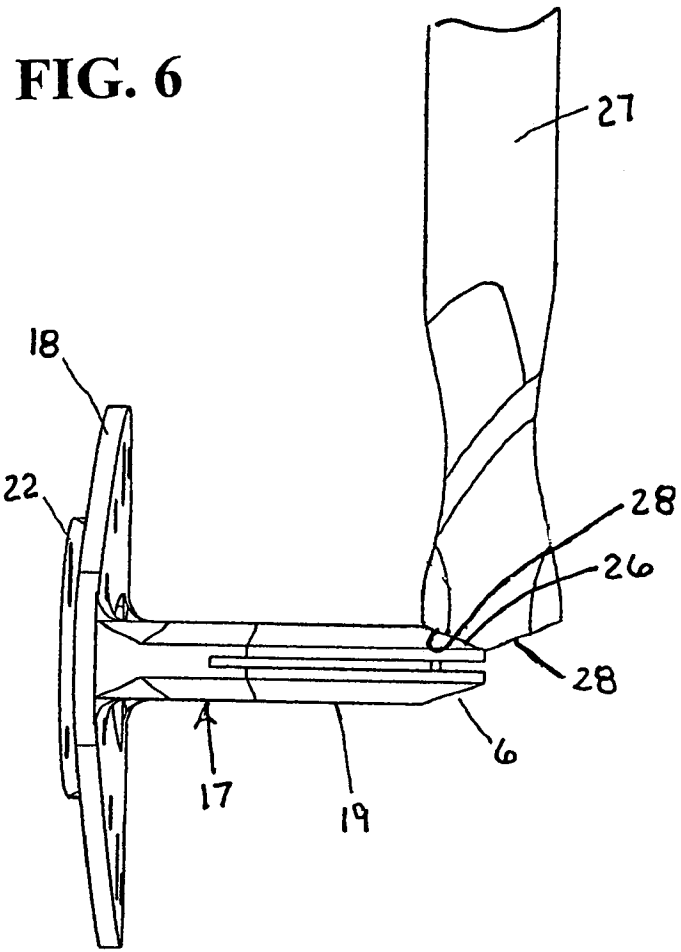
FIG. 6 is a front end view showing how the angle tipped tool cutting the bottom angle of the skate blade holder.

FIG. 6 is a front view showing how an endmill 27 has an angled tip 28 which cuts the bottom angle 26 which forms the tapered section on the bottom of the skate body section 19. Because the extrusion portion 10 had tapered edge region 13, the bottom angle 26 when cut removes only material that is needed to create the angle 26 along the bottom curved length of the section 19. The presence of the tapered edge region 13 in the extrusion portion thus reduces scrap material during the machine step.

Figure 7:
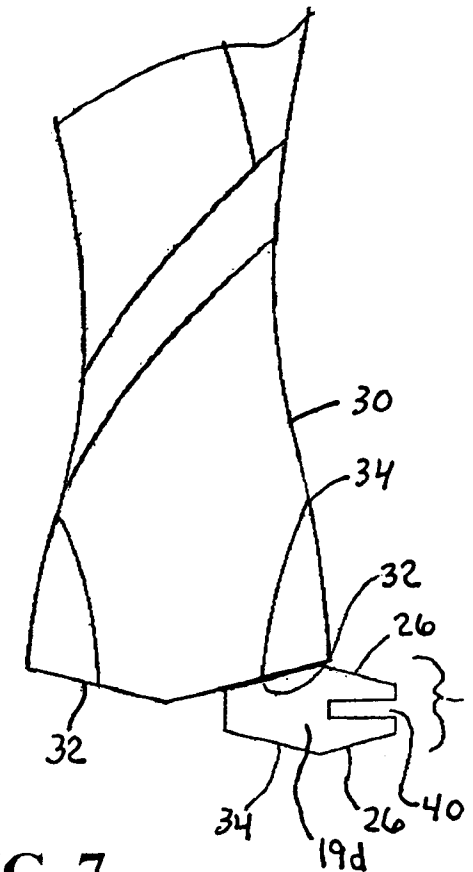
FIG. 7 is a cross-section of the skate blade holder showing a larger, angled tipped tool used to cut the top angle of the skate blade holder, the cross section is taken generally along 8-8 of FIG. 9.
Figure 7A:
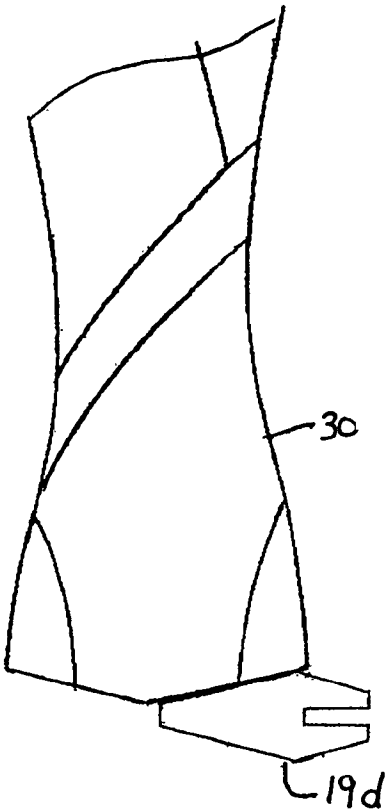
FIG. 7A is a cross-section of the skate blade holder showing a larger, angled tipped tool used to cut the top angle of the skate blade holder, the cross section is taken along 7A-7A of FIG. 9.

FIG. 7 is a cross section of the skate blade body section 19. A slightly larger endmill 30 with an angled tip 32 cuts the top angle 34 on the section 19, particularly on the blade runner holder portion 19*d*.

Figure 8:
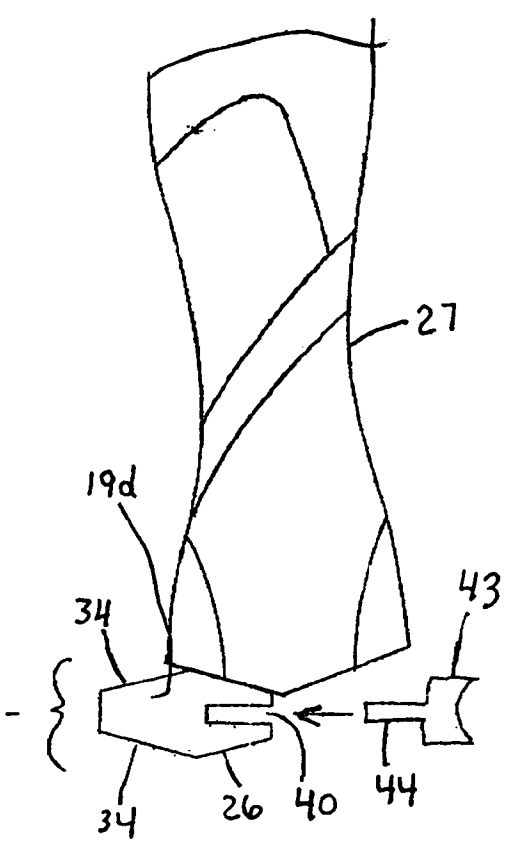
FIG. 8 is a cross-section showing how the tool of FIG. 6 cuts the bottom angle, creating a tapered shape, the cross section is taken generally along 8-8 of FIG. 9.

FIG. 8 illustrates how a smaller endmill 27 is used to cut the lower half of the skate body section 19. Also shown is the slot 40 used to hold a blade runner 43. The slot 40 is machined into the section 19 using an endmill (not shown). The parts match in size and shape but with the slot 40 being slightly larger to allow room for adhesive between the runner 43 and the sidewalls of the slot 40. Preferably, there is a 0.005 in. clearance between each side of the runner 43 and the sidewalls of the slot 40. The blade runner is slid inside and the adhesive holds the runner 43 tightly in place. Ice speed skates are glued together in a similar fashion. Preferably, the blade runner is 420 or 440C stainless steel. Preferably, the adhesive is PERMABOND 310 heat cured at 225 degrees F. for 2.5 hours.

Figure 9:
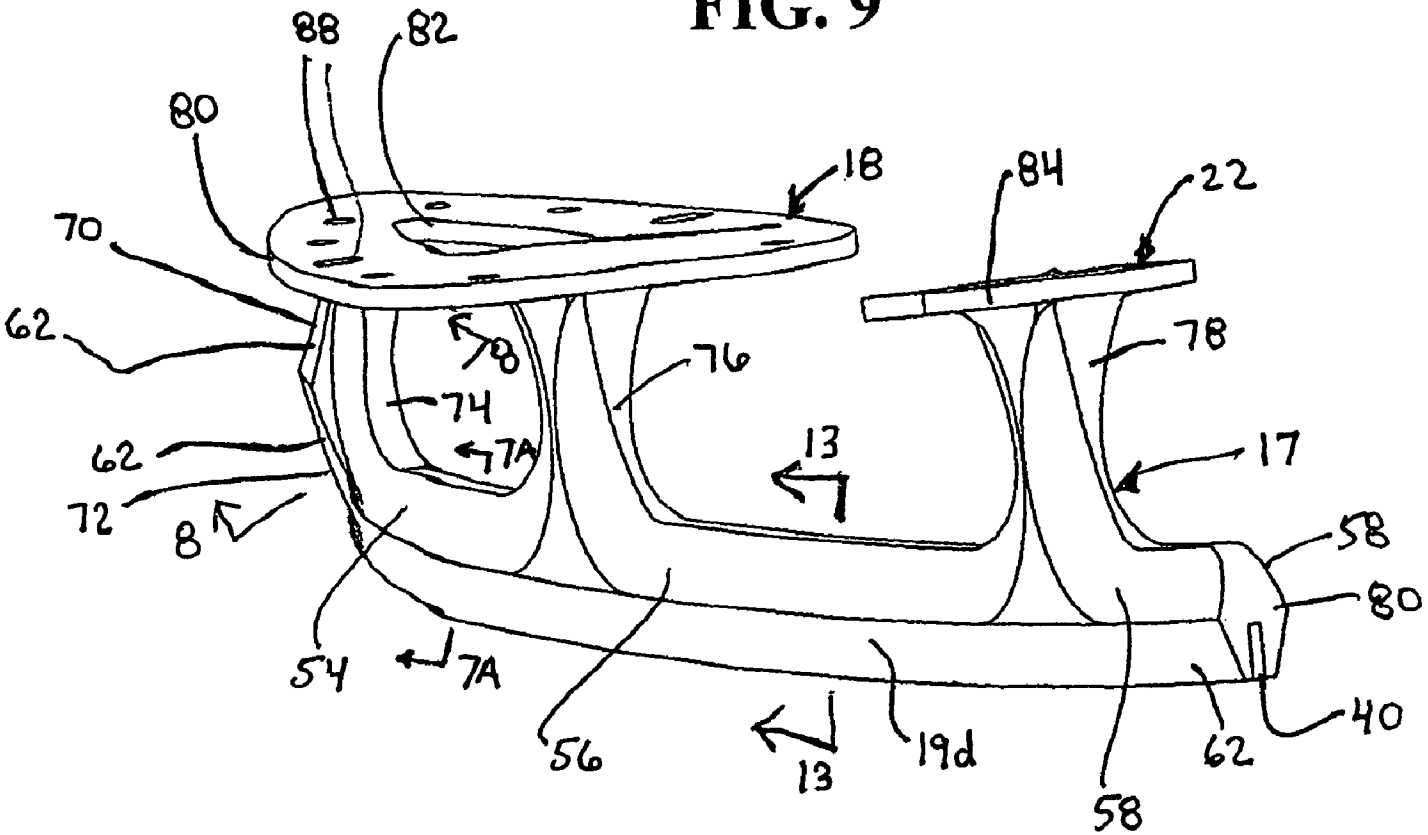
FIG. 9 is a rear perspective view showing the skate blade holder being thicker in the middle section and thinner at either end.

FIG. 9 illustrates a completed skate blade holder shown from a back angle showing how the different skate blade holder thicknesses are formed using the angled tools. The areas 54, 56 and 58 on each side of the section 19 are tapered by the tool 30. The areas 62 on each side of the section 19 are tapered by the tool 27, as necessary. The areas 70, 72, 74, 76, 78, 80 are cut by the tool 24. The shapes of the portions 18, 22, particularly the areas 80, 82, 84, are cut by a similar operation. Mounting holes 88 through the portions 18, 22 for mounting the blade holder 17 to a boot are formed by cutting or drilling in a conventional manner.

Figure 10:
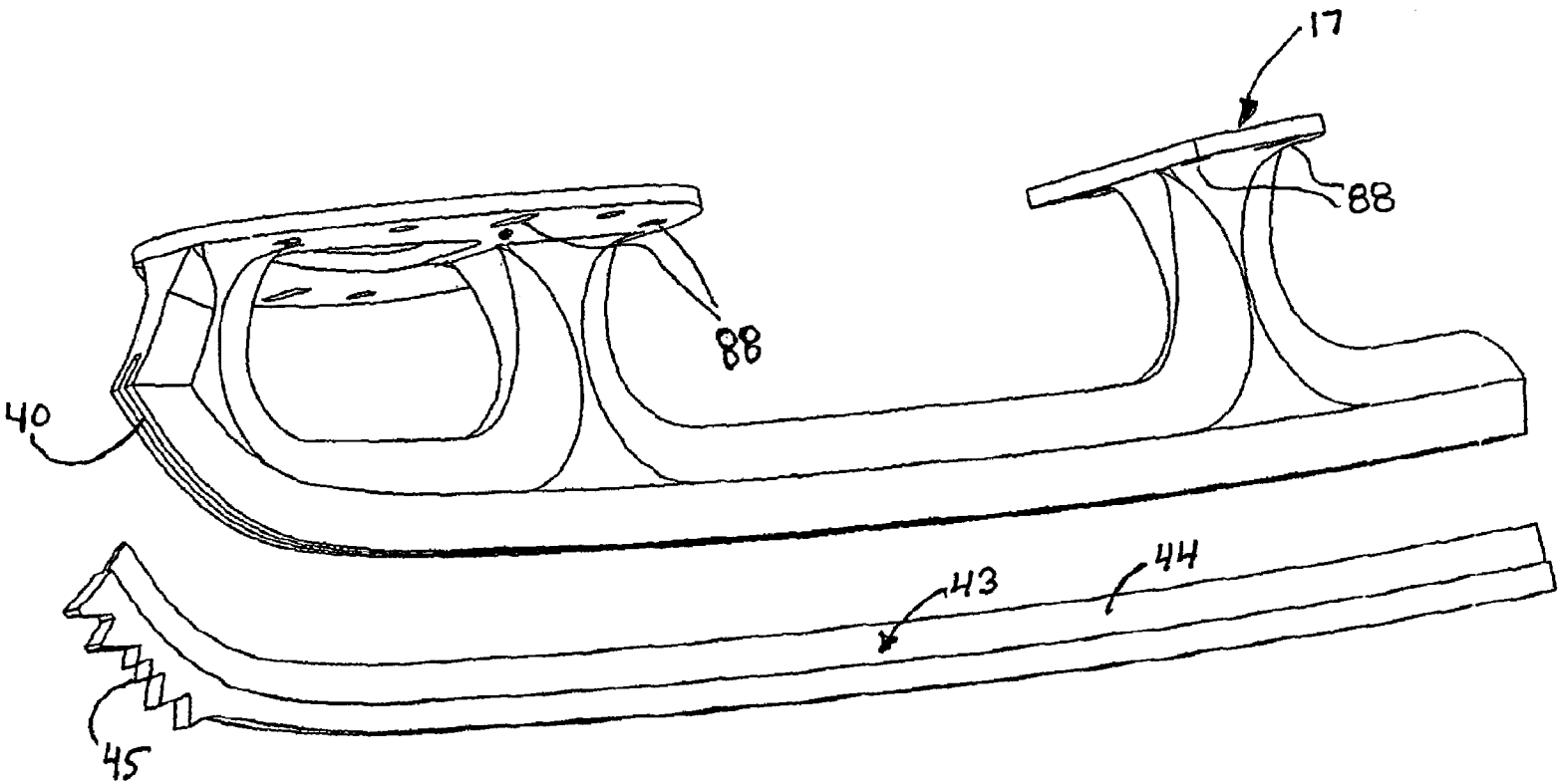
FIG. 10 is a side, perspective, exploded view showing a skate blade runner separated from the skate blade holder.

FIG. 10 is a completed skate blade holder 17 shown with the blade runner 43, before the attaching step. The blade runner has a machined insert portion 44 that is sized to fit within the slot 40. The blade runner has teeth 45 used in figure skating. The blade runner is curved, as is the holder section 19 at its bottom. The slot 40 has a curve along its length to match the curve of the blade runner 43 and insert potion 44.

Figure 11:
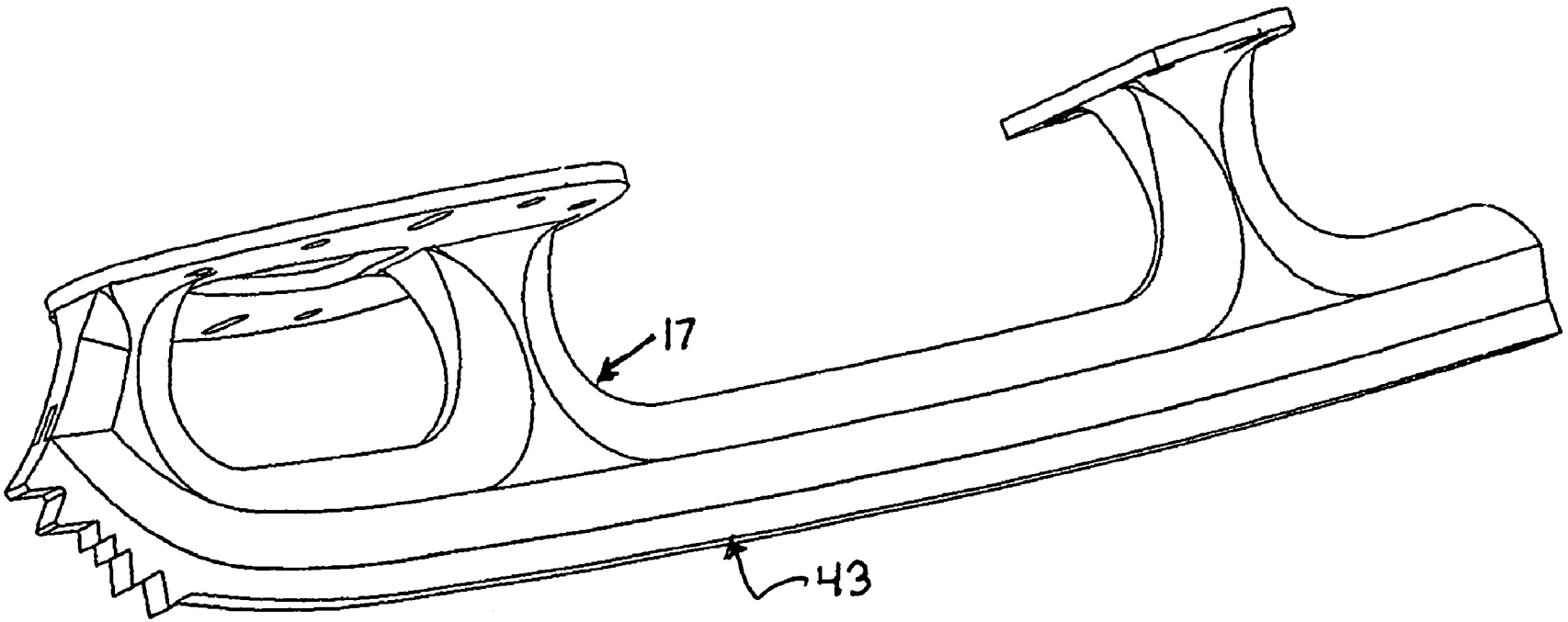
FIG. 11 is a side perspective view showing a completed skate blade holder with the skate blade runner attached.

FIG. 11 is a completely assembled skate blade holder and blade runner.

Figures 12, 12A:
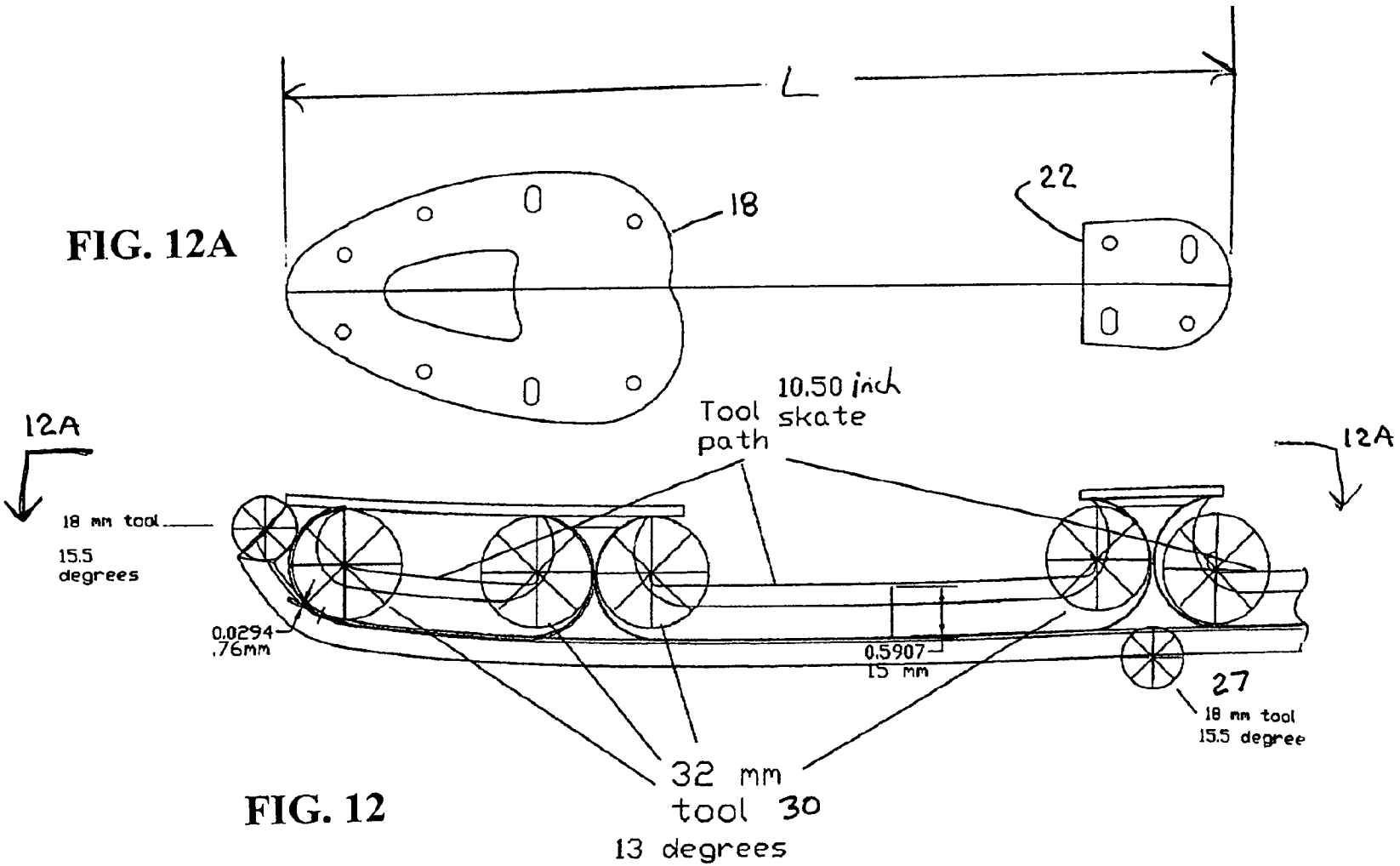
FIG. 12 is a fragmentary side view of the skate blade holder, illustrating the tooling areas and typical tool sizes for a 10.5 inch skate.
FIG. 12A is a fragmentary top view taken generally along line 12A-12A of FIG. 12.

FIG. 12 illustrates the tooling path for the two tools 27, 30 wherein the tool 27 is an 18 mm diameter tool and the tool 30 is a 32 mm diameter tool, for a 10.5 inch skate. This length measurement is indicated as "L" in FIG. 12A, and is measured between the front tip of the toe plate 18 and the back tip of the heel plate 22.

Figure 13A:
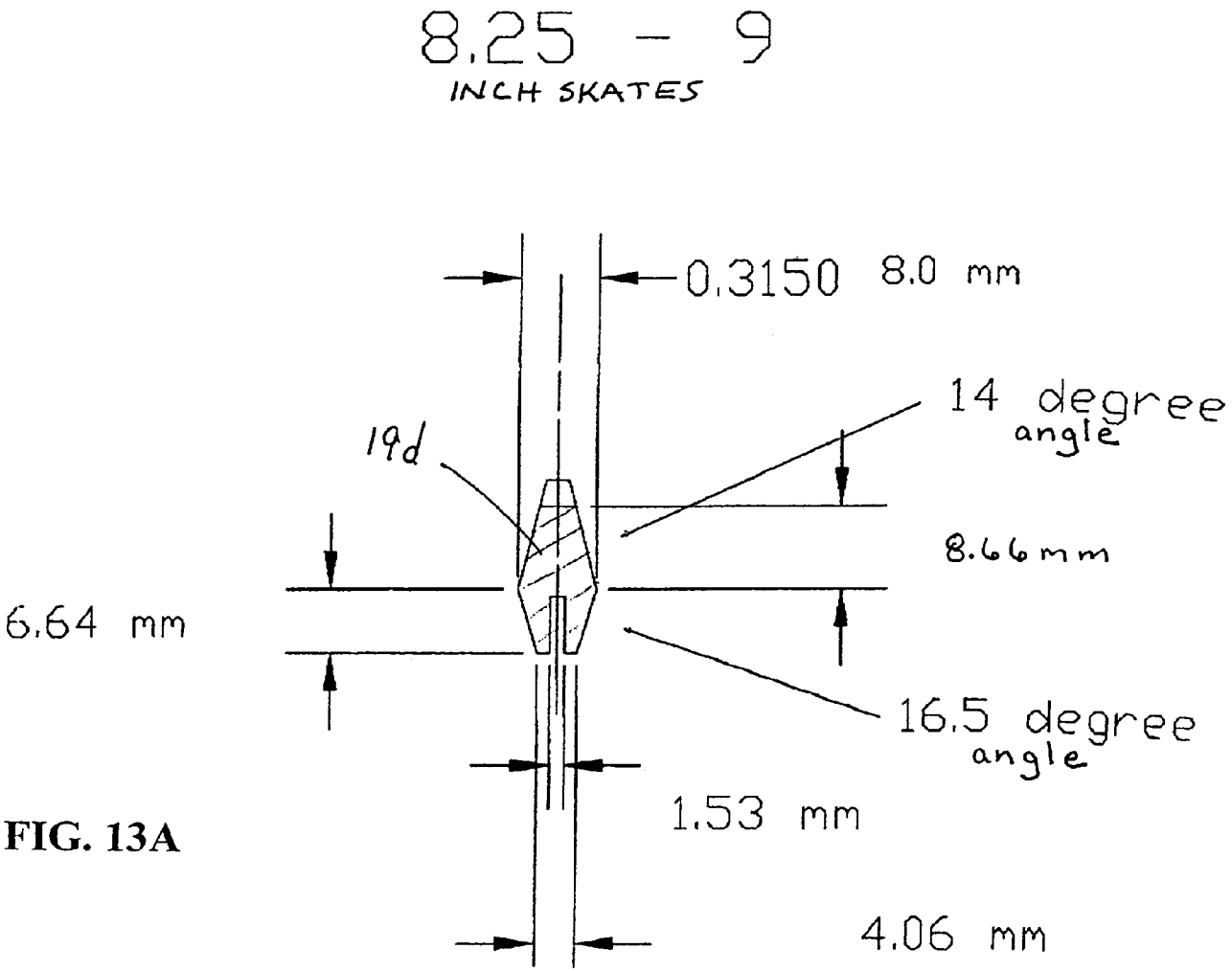
FIG. 13A is a sectional view taken generally along line 13-13 of FIG. 9 for a skate between 8.25 and 9 inches long.
Figure 13B:
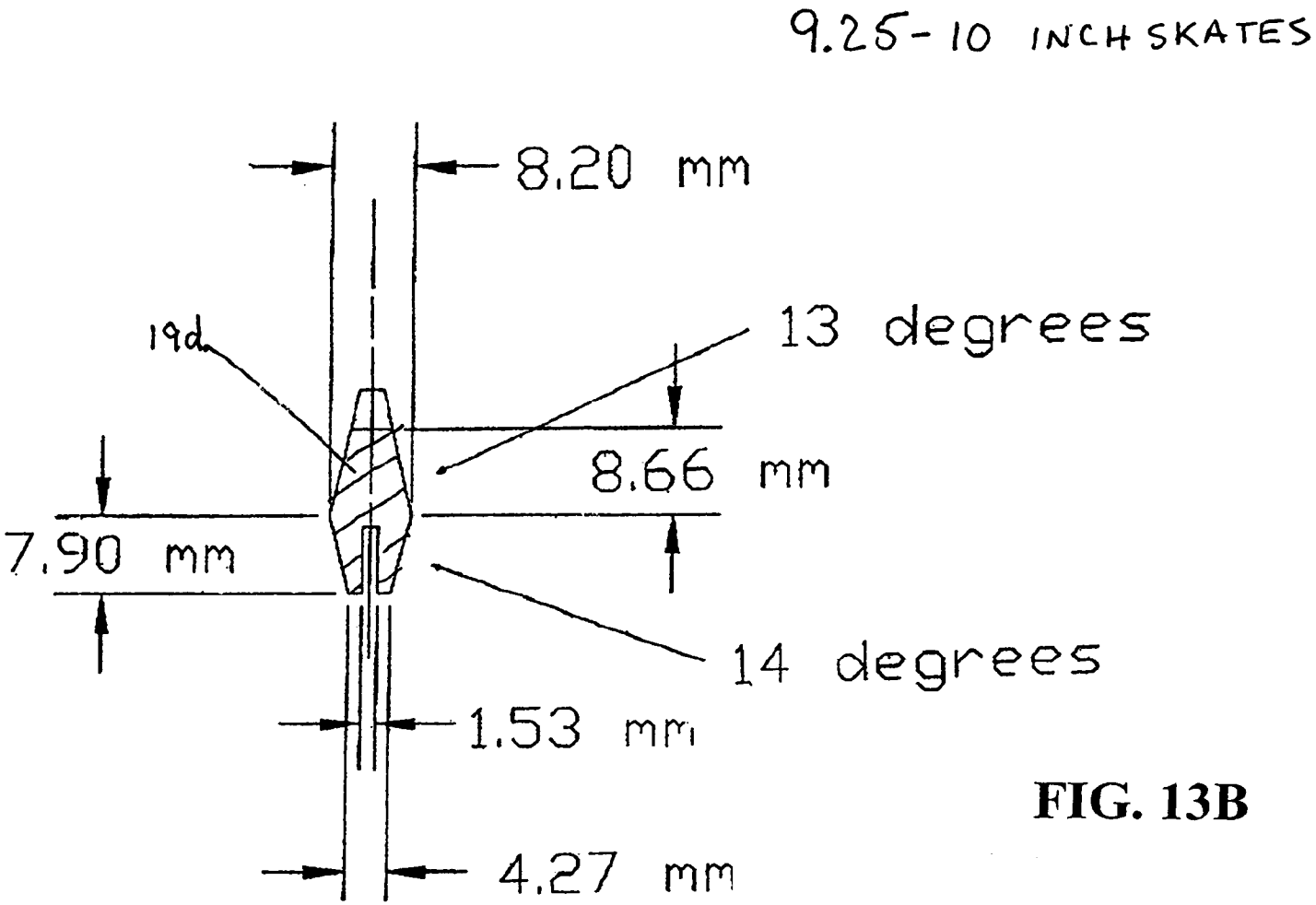
FIG. 13B is a sectional view taken generally along line 13-13 of FIG. 9 for a skate between 9.25 and 10 inches long.
Figure 13C:
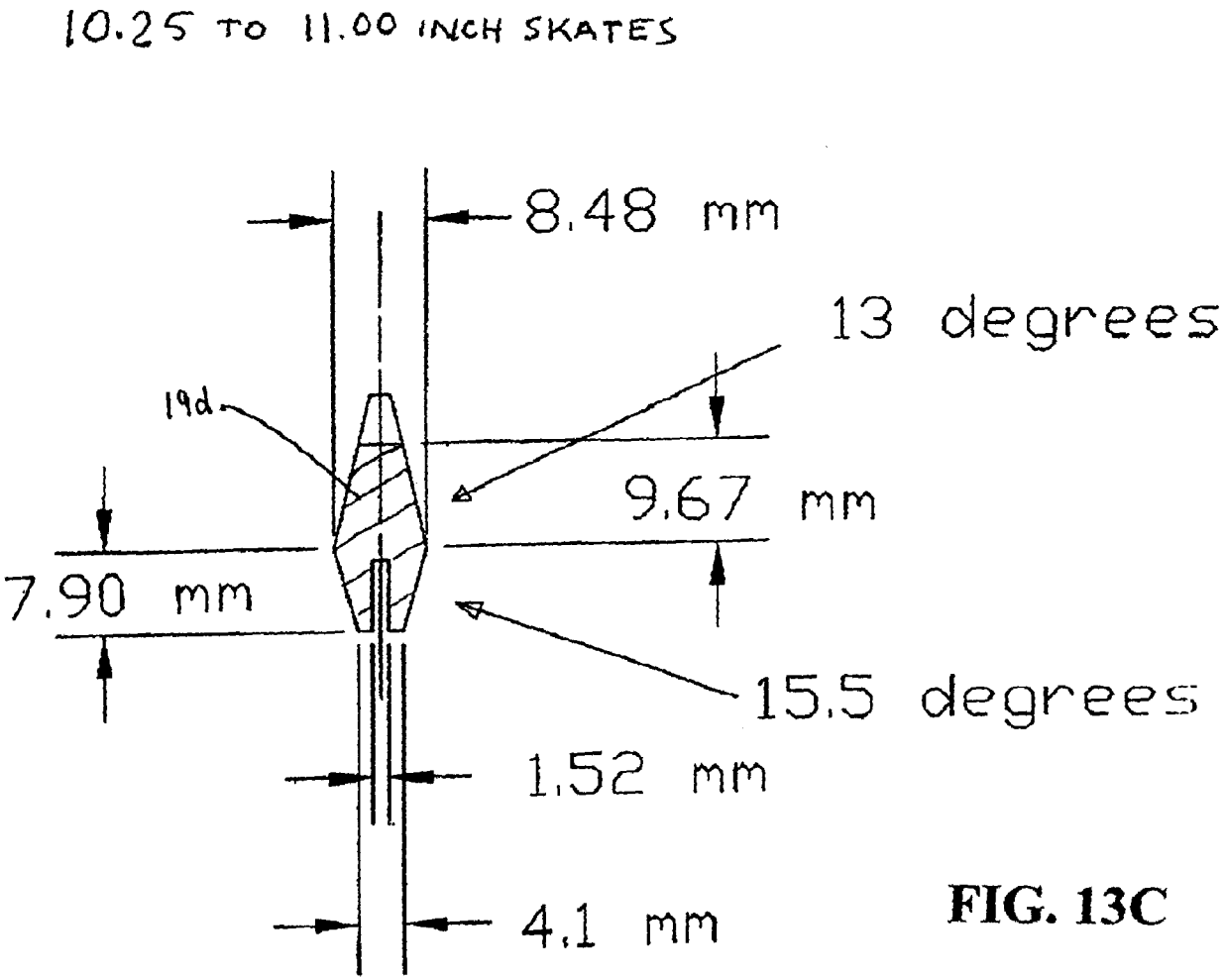
FIG. 13C is a sectional view taken generally along line 13-13 of FIG. 9 for a skate between 10.25 and 11 inches long.

FIG. 13A gives exemplary dimensions of the section 13-13 from FIG. 9 for a skate having L between 8.25 and 9 inches. FIG. 13B gives exemplary dimensions of the section 13-13 from FIG. 9 for a skate having L between 9.25 and 10 inches. FIG. 13C gives exemplary dimensions of the section 13-13 from FIG. 9 for a skate having L between 10.25 and 11 inches.

It should be noted that the skate blade holders illustrated in FIGS. 2, 6, 9, 10 and 11 are substantially drawn to a proportional scale.

Figure 14:
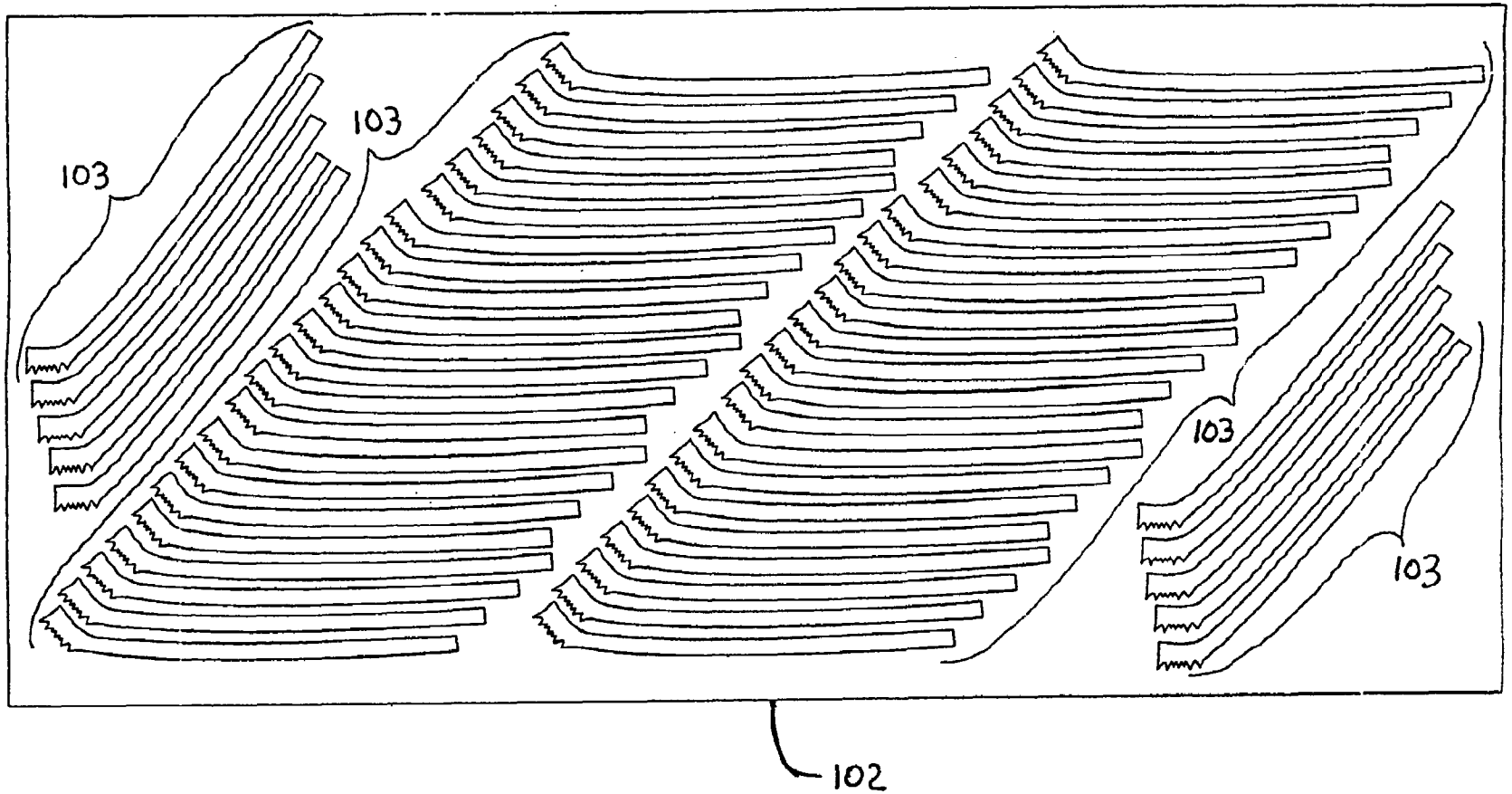
FIG. 14 is a plan view of a sheet of steel showing blade runners to be cut from the sheet of steel.

Referring to FIG. 14, the first step in the inventive process of manufacturing a blade runner is to select a steel sheet 102 having a preferred thickness, which is approximately 4 mm thick. It is preferable to use a large piece or sheet because it fits on the machine better, is more efficient and is a more cost effective use of material. The next step is to laser cut as many blade runner-shaped workpieces or blade stocks 103 as will fit on the sheet of steel 101 as laid out on the sheet 102 in FIG. 14.

Figure 15:
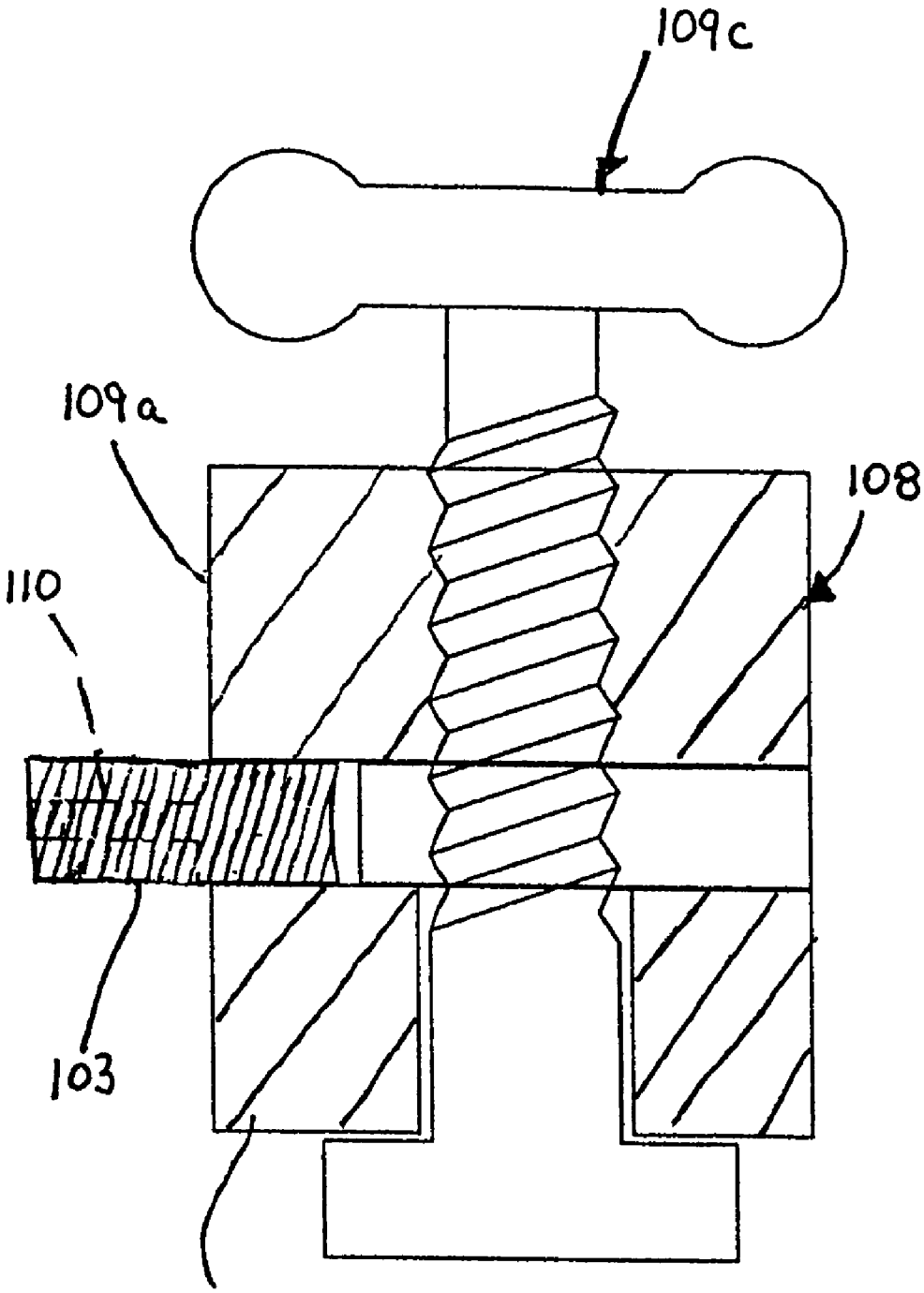
FIG. 15 is a sectional view of a fixture used to hold the blade runner during machining.

As illustrated in FIG. 15, a custom fixture 108, matching the curve of the blade stock, holds the blade stock 103 securely along the entire length of the blade stock 103 while the machining process is being performed. An extra heavy duty fixture 108 is advantageous to hold the small part 103 securely when a great amount of pressure is applied to such a very small part. The fixture 108 includes a first clamp part 109*a* and a second clamp part 109*b* that are drawn together by the threaded engagement of a handle-screw 109*c* that is engaged to the second clamp part 109*b*.

Figure 16:
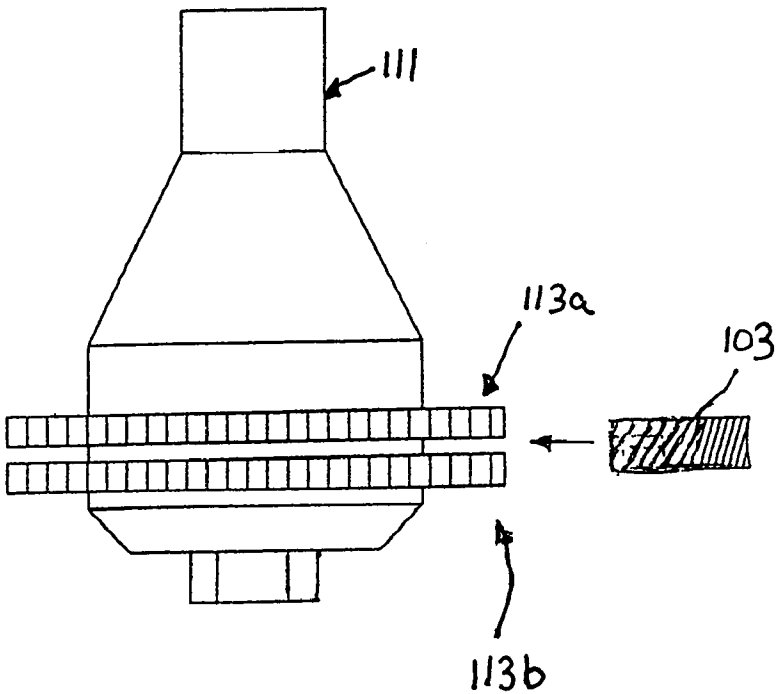
FIG. 16 is a side view of a vein cutter with blade runner in cross section
Figure 18:
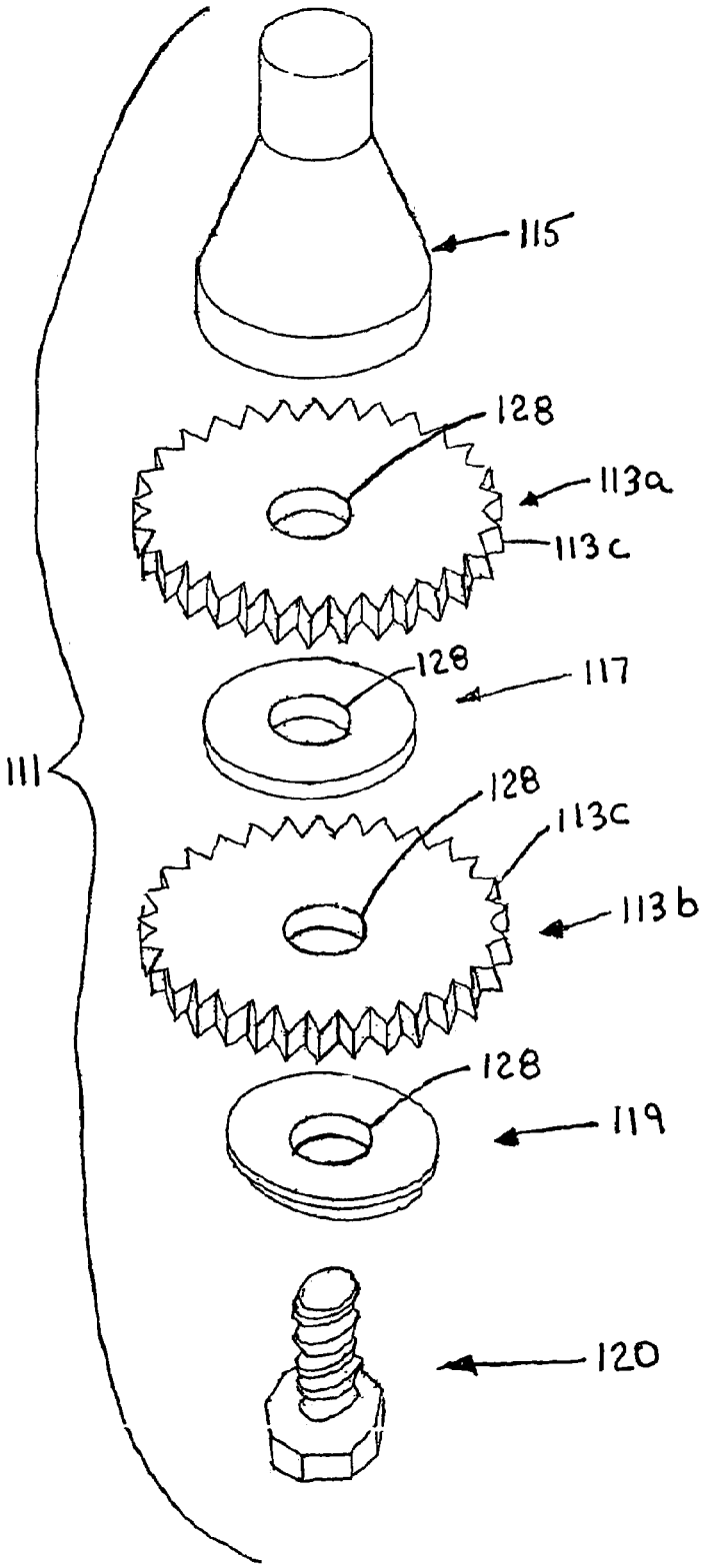
FIG. 18 is an exploded view of a first style vein cutter.

FIG. 16 illustrates a first style vein cutting tool 111 with two identical but separate cutting discs 113*a* and 113*b*, having generally circular shapes with radially extending teeth 113*c* (FIG. 18). The blade stock 103 cross section, with the vein 110 to be cut shown dashed, is shown.

Figure 17:
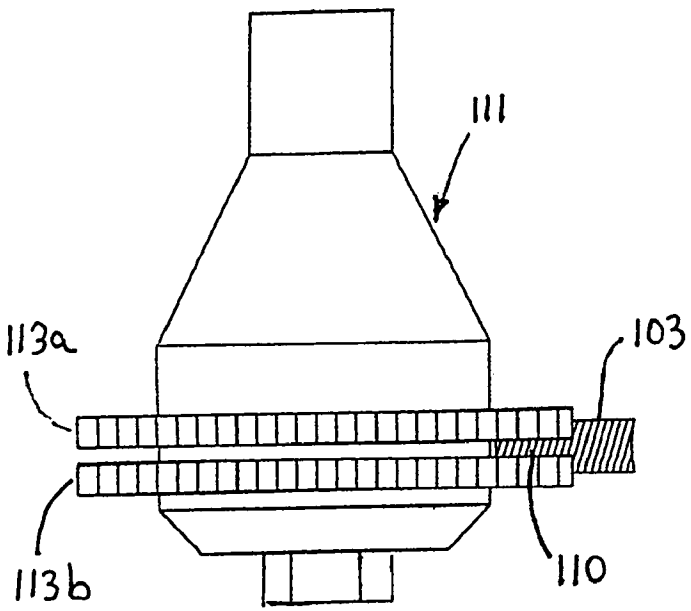
FIG. 17 is a side view of the vein cutter with blade runner in cross section with the blade runner being cut.

FIG. 17 shows the blade stock 103, with the base portion 110 being cut by the vein cutter 111, and how the base portion 110 fits between the two circular cutters 113*a* and 113*b* as it is being cut.

Once the blade stock 103 is properly fixed into the fixture 108, a computer numerically controlled (CNC) machine holding the tool 111 closely follows the curve of the blade stock 103 and cuts the vein or base portion 110 down the entire length of the blade stock 103.

The vein tool 111 is illustrated in FIG. 18 as an exploded view. A male spindle part 115 fits inside the female part on the CNC machine (not shown). The cutting discs 113*a* and 113*b* are both circular saw tooth cutting tools made from carbide. A spacer 117 is sandwiched between the discs 113*a* and 113*b*. The thickness of spacer 117 determines the thickness of the vein or base portion 110. Part 119 is a washer that helps secure and support the assembly. A bolt 120 passes through all the holes 128 and hold the entire assembly together.

Figure 19:
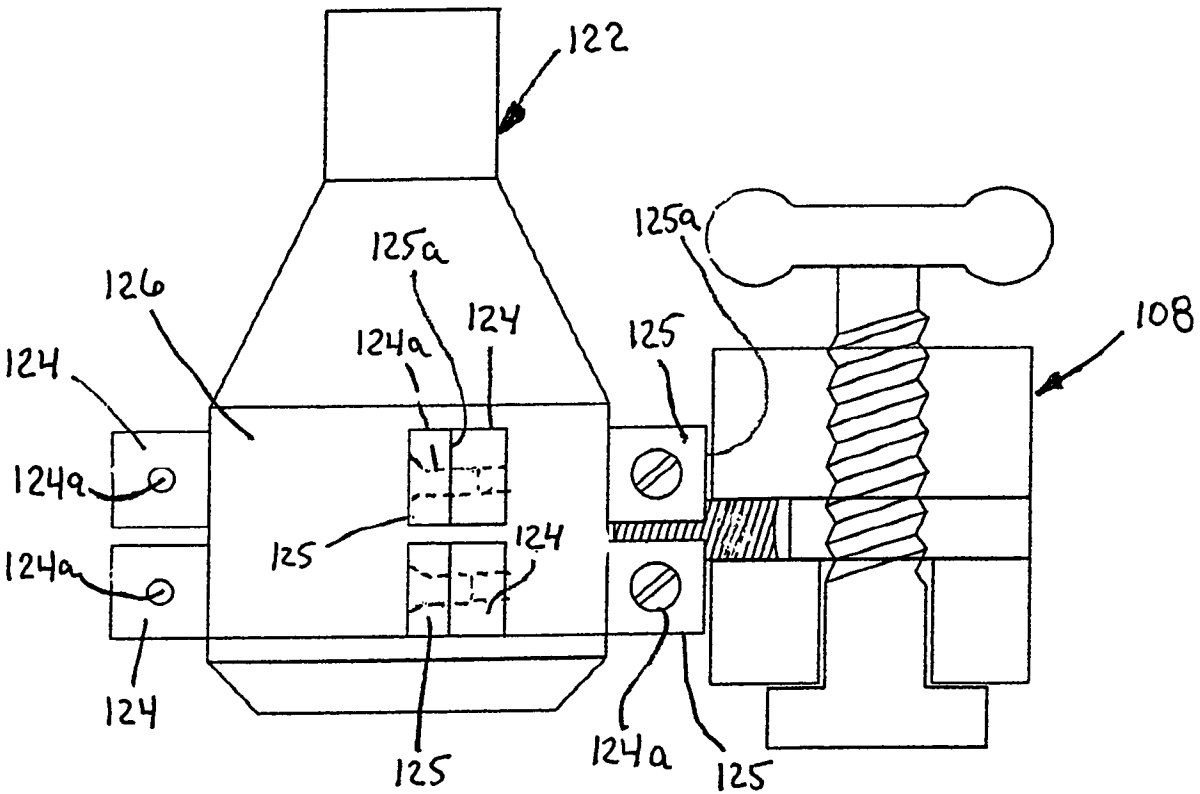
FIG. 19 is an end view, partially in section of a second style vein cutter cutting a blade runner held by the fixture.

FIG. 19 illustrates a different type of vein cutting tool 122, which replaces the circular cutting discs 113*a* and 113*b* with radially extending square cutting bits 125. The cutting bits include a cutting edge 125*a*. The bits 125 are attached by screws 124*a* to tabs 124, formed with or otherwise attached to a hub 126 of the tool 122. Each tab 124 has a threaded bore for engagement by a screw 124*a*. The bits have plain bores. The hub 126 can be a single part or can be two parts separated by a spacer such as shown in FIG. 18. From four to about twenty bits can be used on the one tool 122. The square bits 125 are replaceable, which is both easier and more cost effective to use. Clamping fixture 108 is shown holding the blade stock 103.

Figure 20:
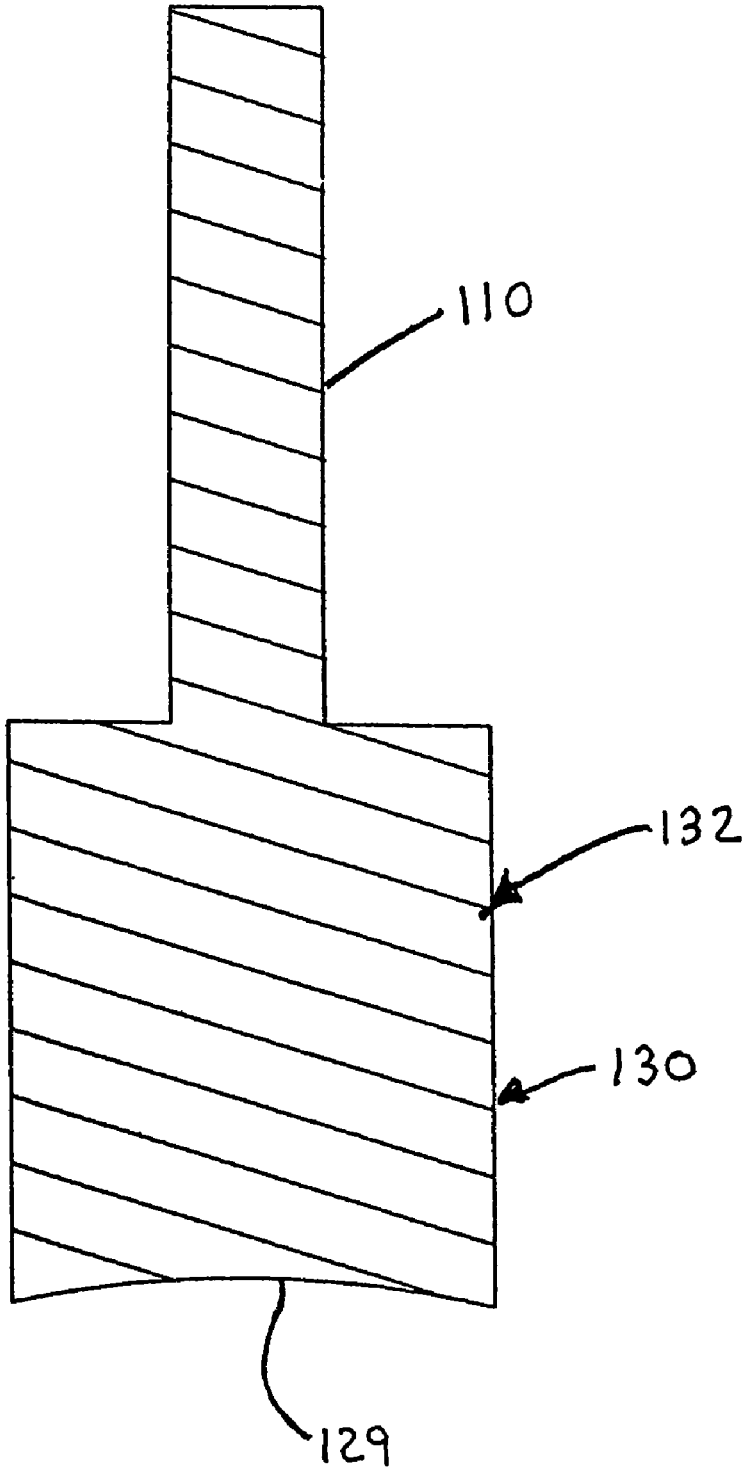
FIG. 20 is a cross of the blade runner.

FIG. 20 is an enlarged view of the cross section of a blade runner 132 after the blade stock 103 has been machined. After the base portion 110 has been cut, the next step in the process is to machine a hollow 129 in the blade portion 130 which is the surface the skater skates on. This could also be done before the base portion 110 is cut.

After all the machining is done the blade runner 132 can then be heat treated. Heat treating before the blade is machined would be more difficult where diamond tools would be needed.

Figure 21:
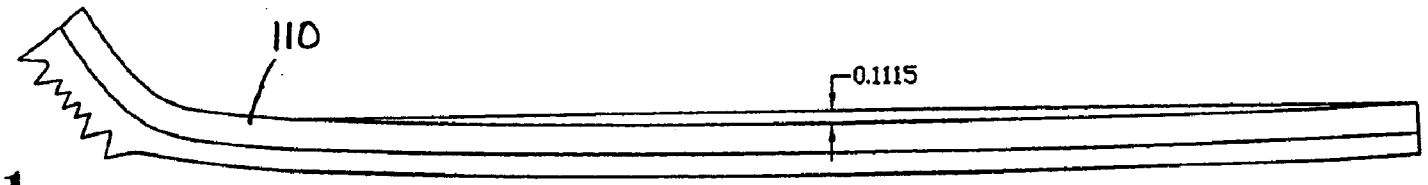
FIG. 21 is an elevational view of a blade runner that has been warped by the heat treating process.

FIG. 21 is a drawing showing a typical blade runner 132 after heat treating where the blade runner 132 tends to straighten out or have less of a curvature after the process. The blade measures 0.1115 inches maximum deviation from straight.

Figure 22:
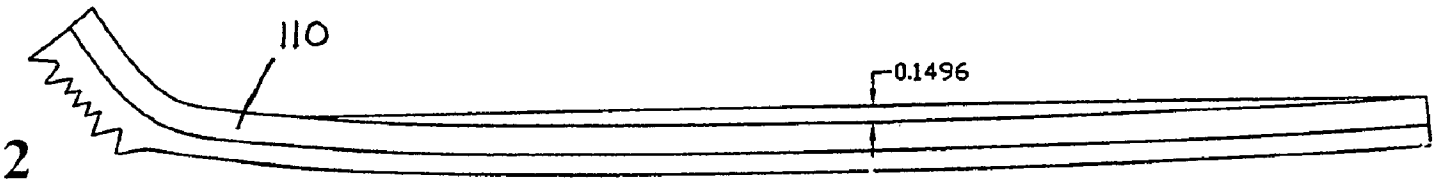
FIG. 22 is an elevational view of a blade runner prior to heat treating showing the correct curvature.

FIG. 22 shows the correct curvature, 0.1496 inches maximum deviation from straight, compared with FIG. 21 at 0.1115 inches.

Some warping or straightening can also be caused by the stress of the machining process.

Figure 23:
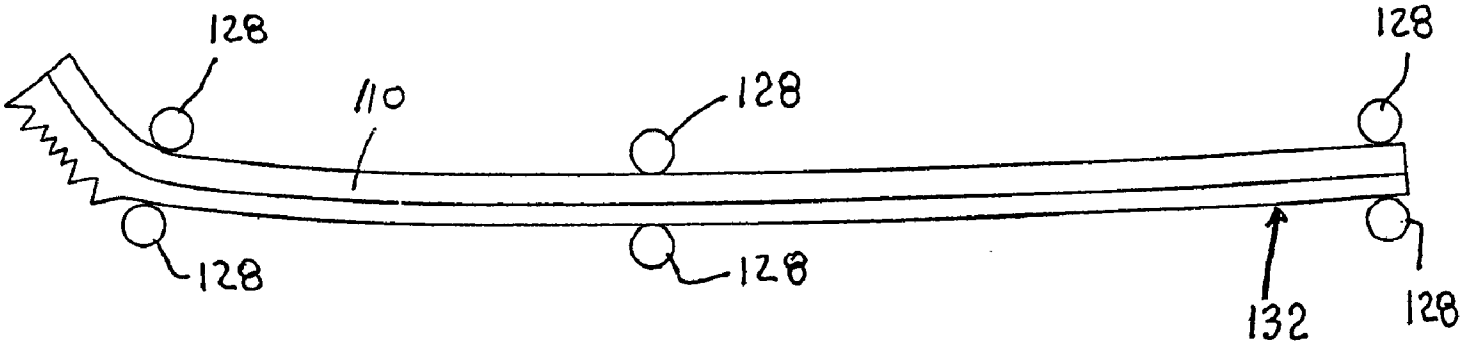
FIG. 23 is an elevational view of a blade runner and correcting apparatus including pins that would hold blade at the correct curve while it is being reheated.

FIG. 23 illustrates how blade runners 132 that are warped can be re-curved. This is done by a reheating process. The blade runners 132 are held in a fixture with pins 128 in the correct curve. They are then reheated to 1000 Fahrenheit for about 10 hours. This process both straightens the blade and reduces stress.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method of manufacturing a blade of an ice skate, comprising the steps of:

providing a T-shaped stock piece of material having a plate and a leg extending from a center of said plate;

machining the plate to form at least one mounting platform for connecting the blade to a skate shoe;

machining the leg to form a skate body section that extends from said platform to a position adjacent the ice when in use; and machining an end of said leg to form a slot, and providing a separate blade runner for contacting the ice when in use, and fixing said blade runner into said slot, wherein said step of machining said skate body section is further defined in that said skate body section is machined to have a blade runner holder portion having a diamond cross-sectional shape throughout a substantial portion of a length thereof that carries said slot and a plurality of pillar portions extending from said blade runner holder portion to said platform.

2. The method according to claim 1, wherein said step of machining said skate body section is further defined in that three pillar portions are formed, and said step of machining said plate is further defined in that said at least one platform comprises a sole plate and a heel plate formed with a gap therebetween, wherein two pillar portions are connected to said sole plate and one pillar portion is connected to said heel plate.

3. The method according to claim 2, wherein said step of machining said skate body section is further defined in that said pillar portions are tapered in both forward and rearward directions.

4. The method according to claim 2, wherein said T-shaped stock piece is composed of aluminum.

5. The method according to claim 4, wherein said separate blade runner is composed of steel.

6. The method according to claim 1, wherein said T-shaped stock piece is composed of aluminum.

7. The method according to claim 6 wherein said separate blade runner is composed of steel.

8. A method of manufacturing a blade of an ice skate, comprising the steps of:

providing a T-shaped stock piece of material having a plate and a leg extending from a center of said plate;

machining the plate to form at least one mounting platform for connecting the blade to a skate shoe;

machining the leg to form a skate body section that extends from said platform to a position adjacent the ice when in use; and machining an end of said leg to form a slot, and providing a separate blade runner for contacting the ice when in use, and fixing said blade runner into said slot, wherein said step of providing a separate blade runner is further defined by the steps of providing a blade runner-shaped workpiece having a substantially constant thickness; and machining both lateral sides of an upper edge region of said blade runner-shaped workpiece simultaneously to form a thinner base region, said base region sized to fit within said slot.

9. The method according to claim 8, wherein said step of machining both lateral sides of said blade runner-shaped workpiece is undertaken using a vein cutting tool.

10. The method according to claim 8, wherein said T-shaped stock piece is composed of aluminum.

11. The method according to claim 10, wherein said separate blade runner is composed of steel.

12. A method of manufacturing a blade of an ice skate, comprising the steps of:

providing a T-shaped stock piece of material having a plate and a leg extending from a center of said plate;

machining the plate to form at least one mounting platform for connecting the blade to a skate shoe;

machining the leg to form a skate body section that extends from said platform to a position adjacent the ice when in use; and machining an end of said leg to form a slot, and providing a separate blade runner for contacting the ice when in use, and fixing said blade runner into said slot, wherein said blade runner comprises a thinner base region and a thicker blade region, wherein said thinner base region is fit within said slot and adhesively secured therein.

13. The method according to claim 12, wherein said T-shaped stock piece is composed of aluminum.

14. The method according to claim 13, wherein said separate blade runner is composed of steel.

15. A blade for an ice skate comprising:

at least one platform for mounting a skate shoe to the blade;

a metal blade body section having at least one pillar portion connected to said platform and terminating in a blade runner holder portion having a diamond shaped cross-section throughout a substantial portion of a length thereof, and in that the cross-section comprises a bottom section of continuous taper to a bottom edge of the blade runner holder portion, and including a slot extending into said bottom edge;

a blade runner having a base portion fixed into said slot and extending from said blade runner holder portion to provide an ice contacting surface.

16. The blade according to claim 15, wherein said at least one platform comprises a sole plate and a heel plate, and said at least one pillar portion comprises at least one pillar portion connecting said sole plate with said blade runner holder portion and at least one pillar portion connecting said heel plate with said blade runner holder portion.

17. The blade according to claim 16, wherein said pillar portions are tapered on both lateral sides in both a front and rear direction.

18. The blade according to claim 15, wherein said metal blade body section is composed of aluminum.

* * * * *